United States Patent [19]

Miyamoto et al.

[11] 4,435,692

[45] Mar. 6, 1984

[54] LOW ELECTROSTATIC CAPACITY WIRE-WOUND TYPE IGNITION CABLE

[75] Inventors: Yoshimi Miyamoto; Naotaka Nakamura, both of Aichi; Fumiyoshi Akaku, Mie; Katsumi Koto, Mie; Tsutomu Kosaka, Mie, all of Japan

[73] Assignees: Sumitomo Electric Industries, Ltd., Osaka; Nippondenso Co., Ltd., Aichi, both of Japan

[21] Appl. No.: 453,976

[22] Filed: Dec. 28, 1982

[30] Foreign Application Priority Data

Dec. 31, 1981 [JP] Japan ..... 56-197606[U]

[51] Int. Cl.[3] ..... H01C 3/06

[52] U.S. Cl. ..... 338/214; 427/44; 174/120 SC; 338/66

[58] Field of Search ..... 338/66, 214; 219/528, 219/541, 544, 549, 553; 174/120 SC, 113 R; 264/22

[56] References Cited

U.S. PATENT DOCUMENTS

| | | | |
|---|---|---|---|
| 4,330,493 | 5/1982 | Miyamoto et al. | 264/22 |
| 4,363,019 | 12/1982 | Miyamoto et al. | 338/214 |
| 4,366,464 | 12/1982 | Miyamoto et al. | 338/214 |
| 4,369,423 | 1/1983 | Holtzberg | 338/66 |

*Primary Examiner*—Volodymyr Y. Mayewsky
*Attorney, Agent, or Firm*—Sughrue, Mion, Zinn, Macpeak & Seas

[57] ABSTRACT

An ignition cable for supplying voltage to the spark plugs of an internal combustion engine, the cable having a low electrostatic capacity such that it does not produce noise in an FM radio frequency band. A central reinforcing string made of aramido-type fibers is covered by a ferrite core. A resistance wire having 8,000–14,000 turns/meter is wound onto the core. The assembly is then coated with a polyolefin insulation layer, a crossed-fiber reinforcement layer, and a silicon sheath, respectively.

12 Claims, 4 Drawing Figures

LOW ELECTROSTATIC CAPACITY WIRE-WOUND TYPE IGNITION CABLE

BACKGROUND OF THE INVENTION

This invention relates to ignition cables used in the ignition circuits of the internal combustion engines of automobiles, and more particularly to a wire-wound type high voltage resistance cable.

Typically, electro-magnetic noises from automobiles using gasoline engines are liable to interfere with the signal receiver of radio sets, television sets or mobile radio stations mounted within the automobile. In order to suppress these noises, the ignition cables of the internal combustion engine of an automobile are typically composed of a noise preventive wire. The main purpose of an ignition cable is to transmit a high voltage from the secondary side of an ignition coil to the ignition plug, without reducing the voltage level in transit, and perform firing of the ignition plug perfectly. Another important purpose of the ignition cable is to attenuate the capacity discharging current which flows during the initial period of ignition plug discharge. The frequency component of this capacity discharging current ranges from the MF band to the UHF band because the rise speed of the current is very high ($10^{-9}$ sec.). This discharging current component is the main cause of the production of noise waves. Since there has been a strong demand for the use of the 80 MHz frequency band as a communications channel, it is especially necessary to suppress the noises in this frequency band.

SUMMARY OF THE INVENTION

An object of the invention is to provide a wire-wound type ignition cable in which the secondary voltage required to charge the ignition plugs is transmitted without decrease, while suppressing the capacity discharging current and maintaining the electrostatic capacity of the cable at a low level.

This and other objects of the invention are realized by constructing a wire-wound type ignition cable having a low electrostatic capacity. A central reinforcing string made of aramido-type fibers is covered by a ferrite core of 1.3 mm or less in thickness. The core is prepared by kneading a base polymer of 100 parts by weight and a ferrite powder of 300 to 700 parts by weight. A resistance wire is wound onto the core such that the number of turns thereof ranges from 8,000 to 14,000. The coiled assembly is then covered with a low dielectric insulation layer, a braid layer, and a silicon sheath, respectively.

BRIEF DESCRIPTION OF THE DRAWINGS

The structure and operation of the present invention will become more apparent upon a detailed description of a preferred embodiment thereof. In the description to follow, reference will be made to the accompanying drawings, in which.

DETAILED DESCRIPTION OF THE PREFERRED EMBODIMENT

When the ignition cable of a vehicle is new (and/or when the sheath at the ignition cable is clean) the secondary voltage of the ignition coil is not decreased during transmission through the cable. However, when an electrically conductive material such as salt or mud attaches to the sheath of the ignition cable, a low impedance is produced with respect to the ground potential, and the charging current flows largely according to the electrostatic capacity between the conductor core (hereinafter referred to merely as "a core" when applicable) and the sheath of the cable. Thus, if the electrostatic capacity of the cable is high, the ignition voltage will be decreased and the ignition plugs will not receive enough voltage to operate properly. In order to eliminate this difficulty, it is necessary to use an ignition cable having a low electrostatic capacity of 90 pF/m or less.

The electrostatic capacity of an ignition cable may be reduced by increasing the outside diameter of the cable. However, it is not desirable to increase the cable diameter, because the resulting cable would not be interchangeable with a conventional cable. Thus, in order to decrease the electrostatic capacity of an ignition cable, the diameter of the core should be reduced.

Thus, the electrostatic capacity of the ignition cable of the invention can be decreased by using both an insulator material and a sheath material which is low in dielectric constant and by decreasing the core diameter. Specifically, it is preferred that a polyolefin material low in dielectric constant be used as the insulating material and EPDM or silicon rubber be used as the sheath material (taking its heat resistance, etc. into consideration). In order to provide an ignition cable having an electrostatic capacity of 90 pF/m or less by using the above-described insulating material and sheath materials, it is necessary to have the ferrite core diameter to 1.3 mm or less.

In order to increase the thickness of the ferrite layer as much as possible, it is necessary that the central reinforcing string be as small in diameter while maintaining a high tensile strength. Thus, it is preferred that an aramido-type fiber be used as the reinforcing string.

A wire-wound type ignition cable can be considered as a line which has distributed parameters such as the pure resistance of the conductor, the inductance of the wound conductor, the stray capacity between the conductors, and the stray capacity between the conductor and the earth (which in practice is the periphery of the engine head). Therefore, an equivalent circuit of an ignition system using the wire-wound type ignition is as shown in FIG. 1.

Figure 1:
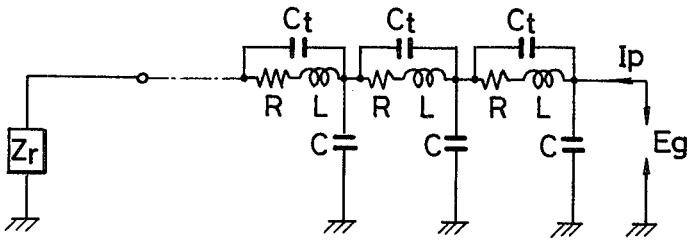
FIG. 1 shows an equivalent circuit of an ignition system with a wire-wound type ignition cable.

In FIG. 1, reference character R designates a pure resistance per unitary length of the ignition cable; L, an inductance per unitary length of the ignition cable; Ct, the stray capacity between the conductors per unitary length; C, the stray capacity between the conductor and the earth per unitary length; Eg, an ignition plug's discharge starting voltage; and Zr, the impedance of the ignition coil.

Accordingly, in the equivalent circuit in FIG. 1, the noise producing current Ip in the plug discharge section can be obtained on the distributed constant circuit principle as follows:

$$I_p = \frac{Eg}{j\omega Z_o} \cdot \frac{1 - P_r \cdot \mathrm{EXP}(-2\gamma l)}{1 + P_r \cdot \mathrm{EXP}(-2\gamma l)} \quad (1)$$

where, $\omega$ is the angular frequency ($\omega = 2\pi f$) of the noise current $I_p$, $Z_o$ is the characteristic impedance of the ignition cable; $P_r$ is the reflection coefficient of the ignition coil; $\gamma$ is a line propagation constant; and l is the length of the line.

Since $\gamma$ is very large such as several KΩ, $$\frac{1 - P_r \cdot \mathrm{EXP}(-2\gamma l)}{1 + P_r \cdot \mathrm{EXP}(-2\gamma l)} \cong 1.$$

Therefore, the equation (1) can be simplified to:

$$I_p = (Eg/j\omega Z_o) \quad (2)$$

Figure 2:
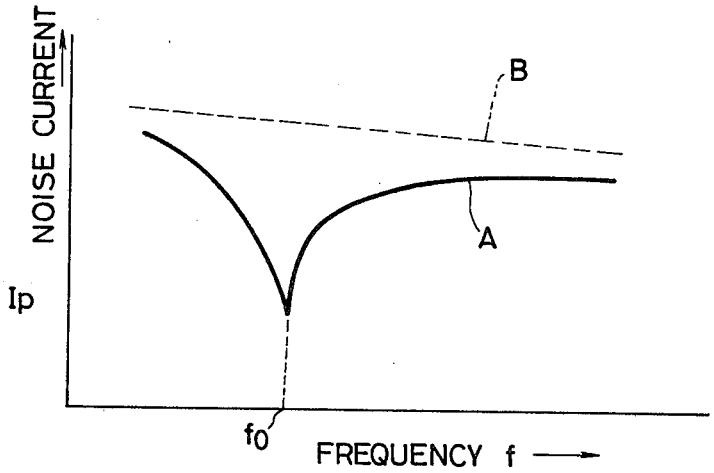
FIG. 2 is a graphical representation showing the noise current spectra carried on a wire-wound type ignition cable.

According to equation (2), the noise current $I_p$ flowing in the wire-wound type ignition cable has a frequency spectrum A (as shown in FIG. 2) which has an anti-resonance frequency $f_o$. Note that the frequency spectrum B of a resistance string type ignition cable of the prior art does not exhibit an anti-resonance characteristic.

From the equivalent circuit of the wire-wound type ignition cable, the anti-resonance frequency $f_o$ is:

$$f_o = \frac{1}{2\pi} \sqrt{\frac{1}{LCt} - \frac{R^2}{L^2}} \quad (3)$$

Because $(1/LCt) >> (R^2/L^2)$, $f_o$ simplifies to:

$$f_o \approx \frac{1}{2\pi} \sqrt{\frac{1}{LCt}} \quad (4)$$

The wire-wound type ignition cable can be considered as a solenoid having a finite length having an inductance L expressed by the equation:

$$L = 4\pi^2 \cdot d_1^2 \cdot \mu s \cdot N^2 \times 10^{-7} (\mathrm{H/m}) \quad (5)$$

where, $d_1$ is the radius of the solenoid core, $\mu s$ is the magnetic permeability of the solenoid core, and N is the number of turns per meter (m). Since the length of the ignition cable is large when compared to the diameter of the solenoid core, the Nagaoka coefficient = 1.

According to the results of extensive research, it has been found that in order to effectively prevent the production of noises in the FM radio frequency band, the structure of a wire-wound type ignition cable should be designed as follows:

In order to efficiently prevent the production of noise waves in the FM radio frequency band, the anti-resonance frequency $f_o$ is set near 80 MHz. In order to provide $f_o$ = 80 MHz, Ct = 0.005 pF/m is entered into equation (4). Accordingly, L = 792 μH/m.

In order to hold the electrostatic capacity is set to 90 pF/m or less, $d_1$ is set at 0.65 mm and L is maintained at 792 μH/m. Accordingly, $$\mu s N^2 = 4.75 \times 10^8 \quad (6)$$

Figure 3:
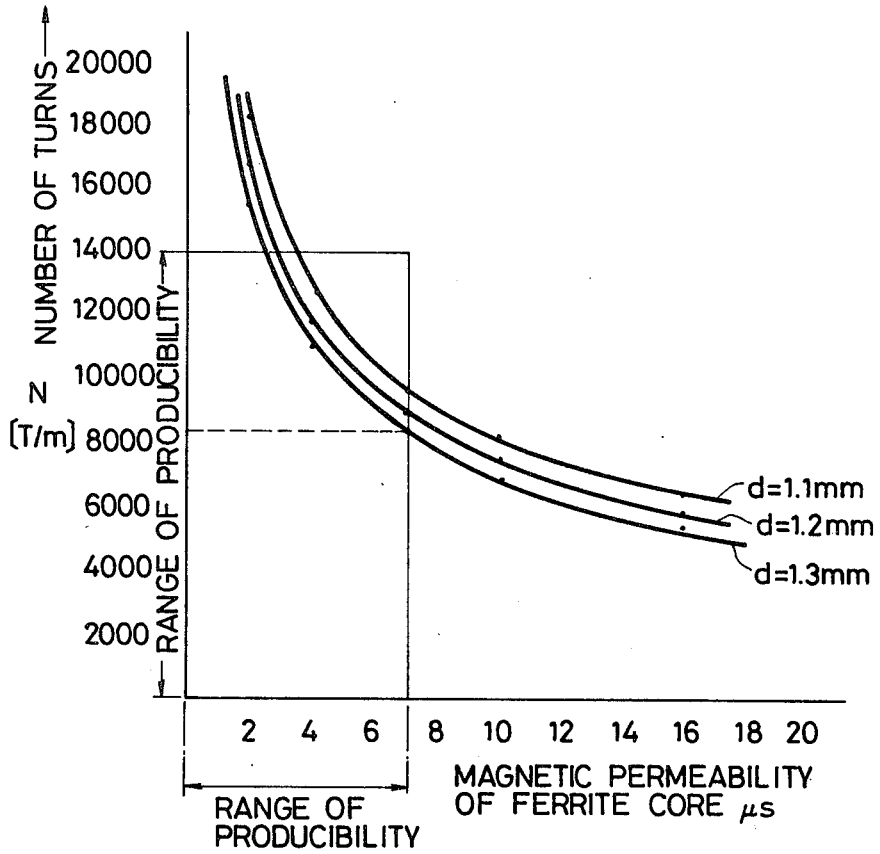
FIG. 3 is a graphical representation indicating the relationships between the magnetic permeability $\mu s$ and the number of turns per meter N which satisfy the impedance of a wire-wound type ignition cable $L=800$ $\mu H/m$.

This relation is as indicated in FIG. 3.

The magnetic permeability of a ferrite core which is manufactured by extruding a mixture prepared by kneading a base polymer such as chlorinated polyethylene or EPDM and ferrite powder can be expressed as follows:

$$\mu s = \mu_1 \frac{2\mu_1 + \mu_2 - 2q(\mu_1 - \mu_2)}{2\mu_1 + \mu_2 + q(\mu_1 + \mu_2)} \quad (7)$$

where, $\mu_1$ is the specific permeability of ferrite, $\mu_2$ is the specific permeability of the base polymer, and q is the ratio of the volume of ferrite powder to the volume of the entire ferrite core layer.

In Equation (7), in the case where $\mu_1 = 2000$ and $\mu_2 = 1$, and the mixture is prepared by mixing a maximum quantity of ferrite powder with the base polymer, q = 0.74 and $\mu s = 10$. However, the degree of extrusion of ferrite rubber is limited when the cover thereof is formed by extruding the ferrite layer. Accordingly, the degree of kneading of ferrite powder is also limited such that q is no more than 0.6 (60%). In this case, the permeability $\mu s$ actually measured is of the order of seven. Accordingly, from Equation (6), N is about 8300 T/m.

In the case where the permeability $\mu s$ is smaller than seven or where the ferrite core diameter is smaller than 1.3 mm, as is apparent from Equation (6) it is necessary to increase the number of turns (N). However, if the number of turns is increased drastically, the wound conductors may contact one another, such that the manufacturing speed is decreased while the manufacturing cost is increased. Thus, the maximum number of turns is in the order of 14,000 turns/m. Accordingly, a suitable number of turns for the winding type ignition cable of the invention ranges from about 8,000 turns/m to about 14,000 turns/m. Note that heretofore the numbers of turns of a wire-wound type ignition cable ranged from 4,000 to 6,000 turns/m.

Figure 4:
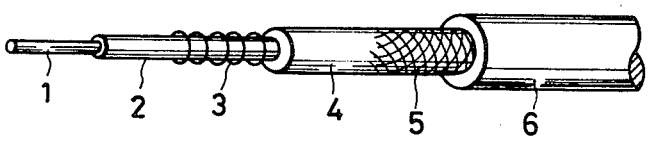
FIG. 4 is a perspective view with cut-away portions showing a preferred embodiment of an ignition cable according to the present invention.

A preferred embodiment of the ignition cable according to the invention will now be described with reference to FIG. 4. A mixture is prepared by kneading chlorinated polyethylene of 100 parts by weight and Mn-Zn ferrite powder of 500 parts by weight. The mixture thus prepared is extruded to cover a central reinforcing string 1 (such as an aramido-type fiber of 1500 deniers) so that the resultant outside diameter is 1.3 mm. A "Nichrome" wire 3, 0.06 mm in outside diameter and 105 μΩ-cm in specific resistance, is wound 9,600 turns per meter on the ferrite core thus fabricated. An insulating material, which is prepared by blending polyethylene and ethylene propylene diene mixture (EPDM) having a low dielectric constant, is extruded to form a cover layer 4 on the ferrite core on which the "Nichrome" wire 3 had been wound. The resultant outside diameter is 4.6 mm. Thereafter, glass fibers are braided to form a reinforcing braid 5 which surrounds the cover layer 4. Finally, a sheath layer 6 is formed on the reinforcing braid 5 with silicon rubber. The resultant outside diameter of the cable is 7.0 mm.

The low electrostatic capacity wire-wound type ignition cable thus fabricated had an electrostatic capacity of 85 pF/m. Measurement of the field strength of the noises from a vehicle equipped with the ignition cable of the invention has shown that the production of noises in the FM radio frequency band is considerably less than that produced by the ignition cables of the prior art.

Examples of the base polymer for formng the ferrite core layer are chlorinated polyethylene, polyolefin resin, EPDM and silicone. Not only Mn-Zn ferrite but also Ni-Zn ferrite may be employed. The wire wound on the ferrite core may be a "Nichrome" wire, a stainless steel wire, an iron-nickel wire, or any wire which is coated with a magnetic material. A mold release such as silicone oil or paraffin may be applied to the wire wound on the ferrite core in order to provide an easy pin insertion at the end thereof. Examples of the dielectric material for providing the low electrostatic capacity are crystalline polyethylene, non-crystalline polyolefin resin such as ethylene propylene copolymer (including ethylene propylene diene mixture (EPDM)), ethylene-α-olefin copolymer, or the blend compounds thereof. Instead of the braid of glass fibers, a perforated tape may be employed as the reinforcing layer. Alternatively, the reinforcing layer may be omitted.

In summary, the ignition cable according to the invention has a low winding core diameter. Moreover, by coating the core with a material having a low dielectric constant, the electrostatic capacity of the cable is reduced. Finally, the number of turns of the wound wire is set so that the anti-resonance frequency thereof is set to suppress noise at the widely used 80 MHz frequency.

What is claimed is:

1. A low electrostatic capacity wire-wound type ignition cable, comprising:

a central reinforcing string;

a ferrite core having a diameter of 1.3 mm or less formed on said central reinforcing string;

a resistance wire, said wire being wound on said ferrite core to form a coil having 8,000 to 14,000 turns/m, said coil having an inductance of about 800 μH/m; and an insulating layer formed on said coil, said insulating layer comprising a first material having a low dielectric constant.

2. The low electrostatic capacity wire-wound type ignition cable as recited in claim 1, wherein said ferrite core is formed by extrucing a mixture which is prepared by kneading a base polymer of 100 parts by weight and ferrite powder of 300 to 700 parts by weight.

3. The low electrostatic capacity wire-wound type ignition cable as recited in claim 2, wherein said base polymer is selected from the group consisting of chlorinated polyethylene, polyolefin resin, ethylene propylene diene mixture rubber (EPDM) and silicone rubber.

4. The low electrostatic capacity wire-wound type ignition cable as recited in claim 1, wherein said first material comprises a polyolefin resin.

5. The low electrostatic capacity wire-wound type ignition cable as recited in claim 4, wherein said polyolefin resin comprises a blend of a polyethylene and a non-crystalline polyolefin resin.

6. The low electrostatic capacity wire-wound type ignition cable as recited in claim 4, wherein said polyolefin resin comprises a blend of a polyethylene and a non-crystalline ethylene propylene rubber.

7. The low electrostatic capacity wire-wound type ignition cable as recited in claim 4, wherein said polyolefin resin comprises a blend of a polyethylene and an ethylene-α-olefin copolymer.

8. The low electrostatic capacity wire-wound type ignition cable as claimed in claim 1, wherein said central reinforcing string comprises aramido-type fibers.

9. The low electrostatic capacity wire-wound type ignition cable as claimed in claim 1, further comprising:

a reinforcing layer formed on said insulating layer, said reinforcing layer comprising a braid of glass fibers.

10. The low electrostatic capacity wire-wound type ignition cable as recited in claim 9, wherein said reinforcing layer comprises a perforated tape.

11. The low electrostatic capacity wire-wound type ignition cable as recited in claim 9, wherein said reinforcing layer is covered with a sheath layer.

12. The low electrostatic capacity wire-wound type ignition cable as recited in claim 1, further comprising:

a sheath layer formed on said insulating layer.

* * * * *